United States Patent [19]

Nishio et al.

[11] 4,287,101

[45] Sep. 1, 1981

[54] ENZYME-CONTAINING DETERGENT COMPOSITION

[75] Inventors: Hiroshi Nishio; Kazuaki Fukano, both of Chiba; Isao Amano, Tokyo; Osamu Okumura, Funabashi, all of Japan

[73] Assignee: The Lion Fat & Oil Co., Ltd., Tokyo, Japan

[21] Appl. No.: 134,453

[22] Filed: Mar. 27, 1980

[30] Foreign Application Priority Data

Oct. 29, 1979 [JP] Japan ..... 54-139478

[51] Int. Cl.[3] ..... C11D 3/065; C11D 3/386

[52] U.S. Cl. ..... 252/537; 252/174.12; 252/556; 252/DIG. 12

[58] Field of Search ..... 252/174.12, DIG. 12, 252/537, 556

[56] References Cited

U.S. PATENT DOCUMENTS

| | | | |
|---|---|---|---|
| 3,600,318 | 8/1971 | Mast | 252/99 |
| 3,676,374 | 7/1972 | Zaki et al. | 252/DIG. 12 |
| 3,816,352 | 6/1974 | Loureiro et al. | 252/537 X |

FOREIGN PATENT DOCUMENTS

| | | | |
|---|---|---|---|
| 1194745 | 6/1970 | United Kingdom | 252/556 |

*Primary Examiner*—Mayer Weinblatt
*Attorney, Agent, or Firm*—Armstrong, Nikaido, Marmelstein & Kubovcik

[57] ABSTRACT

An enzyme-containing detergent composition having good deterbency against, especially, soiled spots in fabrics or clothes derived from a combination of sebum from human skin, a slight amount of sweat and invisible fine dust in the air is described. This detergent composition contains (I) (a) at least one olefin sulfonate having 10 to 20 carbon atoms, (b) at least one anionic surface active agent having an $SO_3$ or $SO_4$ group, except for said olefin sulfonate, and (c) at least one pyrophosphate and (II) at least one enzyme, the total amount of said components (a), (b) and (c) being at least 25% by weight based on the total amount of the detergent composition and the weight ratio of (a):(b):(c) being within the area enclosed by the points A, B, C and D defined in the attached triangular diagram.

3 Claims, 1 Drawing Figure

ENZYME-CONTAINING DETERGENT COMPOSITION

BACKGROUND OF THE INVENTION

1. Field of the Invention

The present invention relates to enzyme-containing detergent compositions and, more specifically, it relates to enzyme-containing detergent compositions suitable for use, as laundry detergents, in washing fabrics or clothes.

2. Description of the Prior Art

Various kinds of soiled portions in fabrics or clothes are heretofore washed with common detergent compositions. However, these soiled portions are, for example, classified as follows:

(i) Mud adhered to infant play clothes.

(ii) Soiled spots or stains derived from sweat or a combination of sweat and mud.

(iii) Soiled spots or stains derived from food such as edible oils, soy source, starches and the like.

(iv) Soiled spots or stains derived from secretions such as blood, pus, urine, excrements and the like.

(v) Soiled spots or stains derived from mechanical oils, or a combination of mechanical oils and iron filings, iron rust and the like.

(vi) Soiled spots derived from a combination of sebum (or smegma) from human skin, a slight amount of sweat and invisible fine dust in the air.

The detergency of detergent compositions largely depends upon the above mentioned kinds of soiled spots to be washed. In this regard although a certain type of detergent composition may exhibit strong detergency against one kind of soiled spots, it may not exhibit good detergency against another kind of soiled spots. This phenomenon is common in the art. For this reason, it is not unusual that even detergent compositions known to have strong detergency do not exhibit good detergency against all kinds of soiled spots.

The addition of enzymes into detergent compositions is known in the art to improve the detergency thereof. Such enzyme-containing detergent compositions are disclosed, for example, in U.S. Pat. Nos. 3,519,379 3,600,319, 3,627,680, 3,627,683, 3,635,828, 3,658,727, 3,664,961 and 3,707,505. However, these prior arts do not teach the technique by which the effect of the enzyme can be fully and effectively utilized. Since the effect of the enzyme is not fully and effectively utilized in the conventional enzyme-containing detergents, it is desired to fully utilize the effect of the enzyme in the enzyme-containing detergent composition.

SUMMARY OF THE INVENTION

An object of the present invention is to provide an enzyme-containing detergent composition having strong detergency, especially, against soiled spots in fabrics or clothes derived from a combination of sebum (or smegma) from human skin, a slight amount of sweat and invisible fine dust in the air.

Another object of the present invention is to fully and effectively utilize the effect of the enzyme in the enzyme-containing detergent composition.

Other objects and advantages of the present invention will be apparent from the description set forth hereinbelow.

In accordance with the present invention, there is provided an enzyme-containing detergent composition comprising (I) (a) at least one α-olefin sulfonate having 10 to 20 carbon atoms, (b) at least one anionic surface active agent having an $SO_3$ or $SO_4$ group, except for said olefin sulfonate, and (c) at least one pyrophosphate and (II) at least one enzyme, the total amount of said components (a), (b) and (c) being at least 25% by weight based on the total amount of the detergent composition and the weight ratio of (a): (b): (c) being within the area enclosed by the points A[(a):(b):(c)=80:0:20], B[(a):(b):(c)=35:40:25], C[(a):(b):(c)=20:40:40] and D[(a):(b):(c)=55:0:45], defined in the accompanying triangular diagram.

BRIEF DESCRIPTION OF THE DRAWING

The present invention will be better understood from the description set forth below with reference to the accompanying FIGURE which is a triangular diagram illustrating the composition of (a) an olefin sulfonate having 10 to 20 carbon atoms, (b) an anionic surface active agent having an $SO_3$ or $SO_4$ group, except for said olefin sulfonate, and (c) a pyrophosphate.

DESCRIPTION OF THE INVENTION

Figure 1:
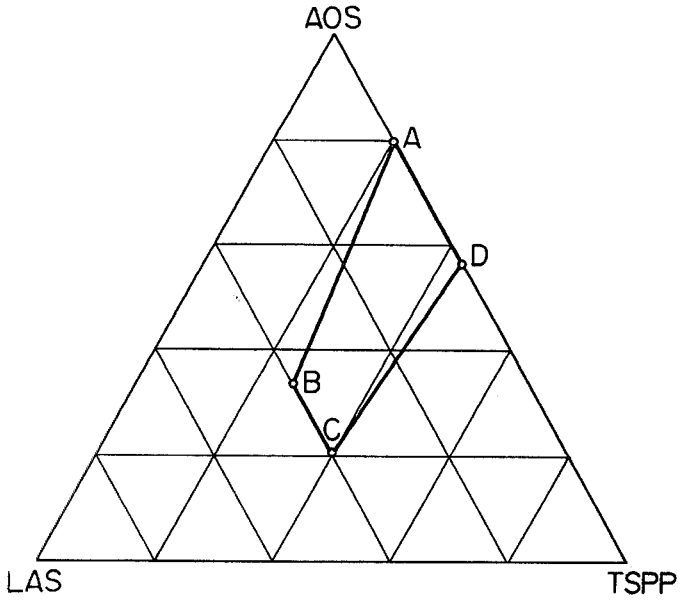

The α-olefin sulfonates used as the component (a), in the present invention include those which can be prepared in any conventional manner. For instance, α-olefins (including vinylidene type olefin) having 10 to 20 carbon atoms on average, which are prepared by wax cracking processes, ethylene oligomerization process utilizing Ziegler catalysts or improved processes thereof, are first sulfonated by gaseous sulfur trioxide diluted with an inert gas, and the sulfonated products are then neutralized with, for example, alkali metal hydroxides, followed by being hydrolyzed. Thus, α-olefin sulfonates are prepared. Typical examples of α-olefin sulfonates are alkali metals (e.g. Na, K), alkaline earth metals (e.g. Ca, Mg) and ammonium and alkanol amine salts, of 1-tetradecene sulfonate, 1-hexadecene sulfonate, 1-octadecene sulfonate and the like.

The anionic surface active agents having an $SO_3$ or $SO_4$ group which are used, as the component (b), in the present invention include, for example, alkylbenzene sulfonates, alkane sulfonates, α-sulfo fatty acid methyl esters, higher alcohol sulfates, higher alcohol polyethyleneglycol ether sulfates and the like. Examples of the counter ions of the salts of these anionic surface active agents are alkali metals (e.g. Na, K), alkaline earth metals (e.g. Ca, Mg), and ammonium and alkanol amine salts.

The pyrophosphates used, as the component (c), in the present invention include those which are generally incorporated, as detergent builders, into the conventional detergent compositions. Examples of such pyrophosphates are sodium pyrophosphate, potassium pyrophosphates and the like. Tripolyphosphates can not be used alone, as the component (c), in the present invention, since the desired effect of the present invention cannot be obtained if tripolyphosphates are so used. However, it is to be understood that up to approximately 10% by weight of the pyrophosphates used, as the component (c), can be replaced with tripolyphosphates.

The components (a), (b) and (c) must be contained in the enzyme-containing detergent compositions of the present invention in an amount of, in total, 25% by weight based on the total amount of the detergent composition. This is because, when the total amount of the components (a), (b) and (c) is less than 25% by weight, the detergency of the enzyme-containing detergent compositions is not sufficient.

Furthermore, the enzyme-containing detergent compositions of the present invention must contain the components (a), (b) and (c) in such an amount that the weight ratio of (a):(b):(c) is within the area enclosed by the points A[(a):(b):(c)=80:0:20], B[(a):(b):(c)=35;40:25], C[(a):(b):(c)=20:40;40] and D[(a):(b):(c)=55:0:45] defined in FIGURE which is a triangular diagram of the components (a), (b) and (c). When the weight ratios of the components (a), (b) and (c) are not within the area enclosed by the points A, B, C and D, the described strong detergency or detergency power, especially, against soiled spots, in fabrics or clothes to be washed, derived from a combination of sebum from human skin, a slight amount of sweat and invisible fine dust in the air cannot be obtained, and the effect of the enzyme in the enzyme-containing detergent composition of the present invention cannot be fully and effectively utilized.

The enzymes incorporated into the detergent composition of the present invention are those which have an activity when their pH is from approximately 4 to approximately 13, specifically, from 7 to approximately 10.5, and a temperature of approximately 10 to approximately 80° C., specifically, 20° to 60° C. Preferable enzymes used in the present invention are proteolytic enzymes (i.e. proteases) derived from bacteria, such as, for example, Alcalase (manufactured by Novo Industri A/S, Denmark), although other enzymes, such as amylases and lipases, may be also used in the present invention. The proteolytic enzymes are preferably used in the detergent compositions of the present invention in such an amount that the resultant enzyme-containing detergent compositions have an enzyme activity of approximately 1 to 40 ANSON units per 1 kg of the resultant detergent composition.

As mentioned hereinabove, the enzyme-containing detergent composition of the present invention contains, as essential ingredients, (I) (a) at least one α-olefin sulfonate having 10 to 20 carbon atoms, (b) at least one anionic surface active agent having an $SO_3$ or $SO_4$ group, except for the olefin sulfonate, and (c) at least one pyrophosphate and (II) at least one enzyme. However, some other conventional detergent ingredients can be optionally contained in the enzyme-containing detergent composition of the present invention.

Examples of such optional ingredients are alkaline agents, such as sodium silicate, sodium carbonate and the like; bleaching agents, such as sodium percarbonate and the like; antiredeposition agents, such as carboxymethyl cellulose (CMC), polyethylene glycol and the like; softening agents; optical bleaching agents; colouring agents; perfumes; pigments; and the like.

The enzyme-containing detergent composition of the present invention can be in the form of, for example, powder, particles and the like. The preparation of the enzyme-containing detergent composition of the present invention can be carried out in any conventional manner known in the art.

EXAMPLES

The present invention will now be further illustrated by, but is by no means limited to, the following Examples, wherein all parts and percentages are expressed on a weight basis unless otherwise noted.

EXAMPLE 1 AND COMPARATIVE EXAMPLE 1

The detergent power or detergency of the various laundry detergent compositions of Run Nos. 25A-a through 60J-b, each having the composition listed in Table 2 below, were tested by washing artificially soiled test fabrics. In order to evaluate the detergent power compositions listed in Table 2 below against soiled spots derived from a combination of sebum from human skin, a slight amount of sweat and invisible fine dust in the air, the artificially soiled test fabrics and other cloths mentioned below were used.

(1) Artificially Soiled Test Fabrics

As an inorganic soiling material, clay containing, as main constituents, crystalline minerals, kaolinite and vermiculite, was used. The clay dried at a temperature of approximately 200° C., for 30 hours, followed by being powdered into grains having an average diameter of approximately 1 micron. To 950 ml of water, 3.5 g of gelatin and 0.25 g of carbon black were added and, after the gelatin was dissolved at a temperature of approximately 40° C., the carbon was dispersed by using POLYTRON (manufactured by Kinematica Co., Swtzerland), which is a strong emulsifier or disperser. Thereafter, 14.9 g of the above mentioned inorganic soiling material was added to the resultant dispersion and dispersed therein by using the POLYTRON. Then, to the resultant dispersion, 31.35 g of oily materials were added and emulsified and dispersed therein by using the POLYTRON. Thus, a stable soiling bath was prepared.

In the above prepared soiling bath, clean fabrics (cotton cloth #60 specified in Japan Oil Chemists' Society), each having a size of 10 cm×20 cm, were soaked, and then, the cloths were squeezed between two rollers made of rubber. Thus, uniformly soiled fabrics were obtained. These soiled fabrics were dried at a temperature of 105° C. for 30 minutes and, then, both surfaces of the soiled fabrics were each rubbed 25 times. The fabrics were cut into 5 cm×5 cm test fabrics. Among these test fabrics, the fabrics having a reflectance of 42±2% were used for the following tests as soiled fabrics. The composition of the materials adhered to the artificially soiled test fabrics are shown in Table 1 below.

TABLE 1

| Soiled Materials Adhered to Artificially Soiled Test Fabrics | |
|---|---|
| Components | % by weight |
| Oily Material | |
| Oleic Acid | 28.3 |
| Triolein | 15.6 |
| Cholesterol Oleate | 12.2 |
| Liquid Paraffin | 2.5 |
| Squalene | 2.5 |
| Cholesterol | 1.6 |
| (Total) | (62.7) |
| Gelatin | 7.0 |
| Inorganic Soiling Material | 29.8 |
| Carbon Black[1] | 0.5 |

[1]Specified by Japan Oil Chemist's Society.

(2) Sebum Cloth

Cloth containing 60 mg of the oily material set forth in Table 1, above, adhered to the cloth (made of cotton yarn having a size of 5 cm×5 cm).

(3) Clean Knitted Cloth

Clean knitted cloth of cotton yarn which was used for preparing the above mentioned "Sebum Cloth".

The washing test procedure and the evaluation standard for detergent power used in the test are as follows.

(1) Washing Test Procedure

Ten artificially soiled test fabrics, three sebum cloths and clean cloths in such an amount that the total weight was 30 g were washed in a washer, named Terg-O-Tometer (U.S. Testing Co.), under the conditions of a bath ratio of 30, a liquid temperature of 30° C. and a residence time of 10 minutes, at 120 rpm. 900 ml of a wash liquor having a detergent concentration of 0.133% was used. After washing, the washed fabrics and cloths were rinsed for 3 minutes with 900 ml of water. The water used was 5° DH.

(2) Evaluation Standard for Detergency

Detergency (%) was determined according to the following calculation.

$$\text{Detergency (\%)} = \frac{(K/S \text{ of Soiled cloth} - K/S \text{ of Washed cloth})}{(K/S \text{ of Soiled cloth} - K/S \text{ of Non-soiled cloth})} \times 100$$

$$\text{wherein } K/S = \left(1 - \frac{R}{100}\right)^2 / \frac{2R}{100}\Big)$$

(Kubelka-Munk's Equation) and R is a reflectance (%) measured by an ELREPHO Reflectometer (manufactured by Carl Zeiss).

The results obtained from the tested artificially soiled test fabrics on average are shown in Table 2 below.

As is clear from the results set forth in Table 2, the detergent compositions of the present invention have high detergent power and the effect of the enzyme contained therein is fully exhibited.

TABLE 2

| Run No. | 25A-a[8] | 25A-b | 25B-a[8] | 25B-b | 25C-a[8] | 25C-b | 25D-a[8] | 25D-b | 25E-a[8] | 25E-b | 25F-a[8] | 25F-b |
|---|---|---|---|---|---|---|---|---|---|---|---|---|
| Detergent Composition (%) | | | | | | | | | | | | |
| AOS[1] | 20 | 20 | 8.8 | 8.8 | 5 | 5 | 13.8 | 13.8 | 17.5 | 17.5 | 12.5 | 12.5 |
| LAS[2] | 0 | 0 | 10 | 10 | 10 | 10 | 0 | 0 | 0 | 0 | 5 | 5 |
| AS[3] | — | — | — | — | — | — | — | — | — | — | — | — |
| TSPP[4] | 5 | 5 | 6.3 | 6.3 | 10 | 10 | 11.3 | 11.3 | 7.5 | 7.5 | 7.5 | 7.5 |
| STP[5] | — | — | — | — | — | — | — | — | — | — | — | — |
| Enzyme[6] | 0.5 | 0 | 0.5 | 0 | 0.5 | 0 | 0.5 | 0 | 0.5 | 0 | 0.5 | 0 |
| Sodium Silicate[7] | 13 | 13 | 13 | 13 | 13 | 13 | 13 | 13 | 13 | 13 | 13 | 13 |
| Sodium Carbonate | 5 | 5 | 5 | 5 | 5 | 5 | 5 | 5 | 5 | 5 | 5 | 5 |
| CMC | 0.6 | 0.6 | 0.6 | 0.6 | 0.6 | 0.6 | 0.6 | 0.6 | 0.6 | 0.6 | 0.6 | 0.6 |
| Glauber's Salt | Balance | Balance | Balance | Balance | Balance | Balance | Balance | Balance | Balance | Balance | Balance | Balance |
| Water | 10 | 10 | 10 | 10 | 10 | 10 | 10 | 10 | 10 | 10 | 10 | 10 |
| Detergency (%) | 78 | 60 | 78 | 60 | 78 | 60 | 78 | 60 | 78 | 60 | 78 | 60 |
| Difference in Detergency (%) | 18 | | 18 | | 18 | | 18 | | 18 | | 18 | |

| Run No. | 25F'-a[8] | 25F'-b | 25F''-a | 25F''-b | 25G-a | 25G-b | 25H-a | 25H-b | 25I-a | 25I-b | 25J-a | 25J-b |
|---|---|---|---|---|---|---|---|---|---|---|---|---|
| Detergent Composition (%) | | | | | | | | | | | | |
| AOS[1] | 12.5 | 12.5 | 12.5 | 12.5 | 22.5 | 22.5 | 7.5 | 7.5 | 2.0 | 2.0 | 11.2 | 11.2 |
| LAS[2] | — | — | 5 | 5 | 0 | 0 | 12.5 | 12.5 | 10.0 | 10.0 | 0 | 0 |
| AS[3] | 5 | 5 | — | — | — | — | — | — | — | — | — | — |
| TSPP[4] | 7.5 | 7.5 | — | — | 2.5 | 2.5 | 5 | 5 | 13.0 | 13.0 | 13.8 | 13.8 |
| STP[5] | — | — | 7.5 | 7.5 | — | — | — | — | — | — | — | — |
| Enzyme[6] | 0.5 | 0 | 0.5 | 0 | 0.5 | 0 | 0.5 | 0 | 0.5 | 0 | 0.5 | 0 |
| Sodium Silicate[7] | 13 | 13 | 13 | 13 | 13 | 13 | 13 | 13 | 13 | 13 | 13 | 13 |
| Sodium Carbonate | 5 | 5 | 5 | 5 | 5 | 5 | 5 | 5 | 5 | 5 | 5 | 5 |
| CMC | 0.6 | 0.6 | 0.6 | 0.6 | 0.6 | 0.6 | 0.6 | 0.6 | 0.6 | 0.6 | 0.6 | 0.6 |
| Glauber's Salt | Balance | Balance | Balance | Balance | Balance | Balance | Balance | Balance | Balance | Balance | Balance | Balance |
| Water | 10 | 10 | 10 | 10 | 10 | 10 | 10 | 10 | 10 | 10 | 10 | 10 |
| Detergency (%) | 77 | 60 | 74 | 59 | 74 | 60 | 74 | 59 | 75 | 59 | 76 | 60 |
| Difference in Detergency (%) | 17 | | 15 | | 14 | | 15 | | 16 | | 16 | |

| Run No. | 38A-a[8] | 38A-b | 38B-a[8] | 38B-b | 38C-a[8] | 38C-b | 38D-a[8] | 38D-b | 38E-a[8] | 38E-b | 38F-a[8] | 38F-b |
|---|---|---|---|---|---|---|---|---|---|---|---|---|
| Detergent Composition (%) | | | | | | | | | | | | |
| AOS[1] | 30.4 | 30.4 | 13.3 | 13.3 | 7.6 | 7.6 | 20.9 | 20.9 | 26.6 | 26.6 | 19.0 | 19.0 |
| LAS[2] | 0 | 0 | 15.2 | 15.2 | 15.2 | 15.2 | 0 | 0 | 0 | 0 | 7.6 | 7.6 |
| AS[3] | — | — | — | — | — | — | — | — | — | — | — | — |
| TSPP[4] | 7.6 | 7.6 | 9.5 | 9.5 | 15.2 | 15.2 | 17.1 | 17.1 | 11.4 | 11.4 | 11.4 | 11.4 |
| STP[5] | — | — | — | — | — | — | — | — | — | — | — | — |
| Enzyme[6] | 0.5 | 0 | 0.5 | 0 | 0.5 | 0 | 0.5 | 0 | 0.5 | 0 | 0.5 | 0 |
| Sodium Silicate[7] | 13 | 13 | 13 | 13 | 13 | 13 | 13 | 13 | 13 | 13 | 13 | 13 |
| Sodium Carbonate | 5 | 5 | 5 | 5 | 5 | 5 | 5 | 5 | 5 | 5 | 5 | 5 |
| CMC | 0.6 | 0.6 | 0.6 | 0.6 | 0.6 | 0.6 | 0.6 | 0.6 | 0.6 | 0.6 | 0.6 | 0.6 |
| Glauber's Salt | Balance | Balance | Balance | Balance | Balance | Balance | Balance | Balance | Balance | Balance | Balance | Balance |
| Water | 10 | 10 | 10 | 10 | 10 | 10 | 10 | 10 | 10 | 10 | 10 | 10 |
| Detergency (%) | 85 | 68 | 85 | 67 | 85 | 67 | 85 | 67 | 85 | 67 | 85 | 67 |
| Difference in Detergency (%) | 17 | | 18 | | 18 | | 18 | | 18 | | 18 | |

| Run No. | 38F'-a[8] | 38F'-b | 38F''-a | 38F''-b | 38G-a | 38G-b | 38H-a | 38H-b | 38I-a | 38I-b | 38J-a | 38J-b |
|---|---|---|---|---|---|---|---|---|---|---|---|---|

TABLE 2-continued

| Detergent Composition (%) | | | | | | | | | | | | |
|---|---|---|---|---|---|---|---|---|---|---|---|---|
| AOS[1] | 19.0 | 19.0 | 19.0 | 19.0 | 34.2 | 34.2 | 11.4 | 11.4 | 3.0 | 3.0 | 17.1 | 17.1 |
| LAS[2] | — | — | 7.6 | 7.6 | 0 | 0 | 19 | 19 | 15.2 | 15.2 | 0 | 0 |
| AS[3] | 7.6 | 7.6 | — | — | — | — | — | — | — | — | — | — |
| TSPP[4] | 11.4 | 11.4 | — | — | 3.8 | 3.8 | 7.6 | 7.6 | 19.8 | 19.8 | 20.9 | 20.9 |
| STP[5] | — | — | 11.4 | 11.4 | — | — | — | — | — | — | — | — |
| Enzyme[6] | 0.5 | 0 | 0.5 | 0 | 0.5 | 0 | 0.5 | 0 | 0.5 | 0 | 0.5 | 0 |
| Sodium Silicate[7] | 13 | 13 | 13 | 13 | 13 | 13 | 13 | 13 | 13 | 13 | 13 | 13 |
| Sodium Carbonate | 5 | 5 | 5 | 5 | 5 | 5 | 5 | 5 | 5 | 5 | 5 | 5 |
| CMC | 0.6 | 0.6 | 0.6 | 0.6 | 0.6 | 0.6 | 0.6 | 0.6 | 0.6 | 0.6 | 0.6 | 0.6 |
| Glauber's Salt | Balance | Balance | Balance | Balance | Balance | Balance | Balance | Balance | Balance | Balance | Balance | Balance |
| Water | 10 | 10 | 10 | 10 | 10 | 10 | 10 | 10 | 10 | 10 | 10 | 10 |
| Detergency (%) | 85 | 67 | 82 | 66 | 83 | 67 | 83 | 67 | 83 | 67 | 83 | 67 |
| Difference in Detergency (%) | 18 | | 16 | | 16 | | 16 | | 16 | | 16 | |

| Run No. | 50A-b[8] | 50A-b | 50B-a[8] | 50B-b | 50C-a[8] | 50C-b | 50D-a[8] | 50D-b | 50E-a[8] | 50E-b | 50F-a[8] | 50F-b |
|---|---|---|---|---|---|---|---|---|---|---|---|---|
| Detergent Composition (%) | | | | | | | | | | | | |
| AOS[1] | 40.0 | 40.0 | 17.5 | 17.5 | 10.0 | 10.0 | 27.5 | 27.5 | 35.0 | 35.0 | 25.0 | 25.0 |
| LAS[2] | 0 | 0 | 20.0 | 20.0 | 20.0 | 20.0 | 0 | 0 | 0 | 0 | 10.0 | 10.0 |
| AS[3] | — | — | — | — | — | — | — | — | — | — | — | — |
| TSPP[4] | 10.0 | 10.0 | 12.5 | 12.5 | 20.0 | 20.0 | 22.5 | 22.5 | 15.0 | 15.0 | 15.0 | 15.0 |
| STP[5] | — | — | — | — | — | — | — | — | — | — | — | — |
| Enzyme[6] | 0.5 | 0 | 0.5 | 0 | 0.5 | 0 | 0.5 | 0 | 0.5 | 0 | 0.5 | 0 |
| Sodium Silicate[7] | 13 | 13 | 13 | 13 | 13 | 13 | 13 | 13 | 13 | 13 | 13 | 13 |
| Sodium Carbonate | 5 | 5 | 5 | 5 | 5 | 5 | 5 | 5 | 5 | 5 | 5 | 5 |
| CMC | 0.6 | 0.6 | 0.6 | 0.6 | 0.6 | 0.6 | 0.6 | 0.6 | 0.6 | 0.6 | 0.6 | 0.6 |
| Glauber's Salt | Balance | Balance | Balance | Balance | Balance | Balance | Balance | Balance | Balance | Balance | Balance | Balance |
| Water | 10 | 10 | 10 | 10 | 10 | 10 | 10 | 10 | 10 | 10 | 10 | 10 |
| Detergency (%) | 86 | 69 | 86 | 68 | 86 | 69 | 86 | 69 | 86 | 69 | 86 | 69 |
| Difference in Detergency (%) | 17 | | 18 | | 17 | | 17 | | 17 | | 17 | |

| Run No. | 50F'-a[8] | 50F'-b | 50F''-a | 50F''-b | 50G-a | 50G-b | 50H-a | 50H-b | 50I-a | 50I-b | 50J-a | 50J-b |
|---|---|---|---|---|---|---|---|---|---|---|---|---|
| Detergent Composition (%) | | | | | | | | | | | | |
| AOS[1] | 25.0 | 25.0 | 25.0 | 25.0 | 45.0 | 45.0 | 15.0 | 15.0 | 4.0 | 4.0 | 22.5 | 22.5 |
| LAS[2] | — | — | 10.0 | 10.0 | 0 | 0 | 25.0 | 25.0 | 20.0 | 20.0 | 0 | 0 |
| AS[3] | 10.0 | 10.0 | — | — | — | — | — | — | — | — | — | — |
| TSPP[4] | 15.0 | 15.0 | — | — | 5.0 | 5.0 | 10.0 | 10.0 | 26.0 | 26.0 | 27.5 | 27.5 |
| STP[5] | — | — | 15.0 | 15.0 | — | — | — | — | — | — | — | — |
| Enzyme[6] | 0.5 | 0 | 0.5 | 0 | 0.5 | 0 | 0.5 | 0 | 0.5 | 0 | 0.5 | 0 |
| Sodium Silicate[7] | 13 | 13 | 13 | 13 | 13 | 13 | 13 | 13 | 13 | 13 | 13 | 13 |
| Sodium Carbonate | 5 | 5 | 5 | 5 | 5 | 5 | 5 | 5 | 5 | 5 | 5 | 5 |
| CMC | 0.6 | 0.6 | 0.6 | 0.6 | 0.6 | 0.6 | 0.6 | 0.6 | 0.6 | 0.6 | 0.6 | 0.6 |
| Glauber's Salt | Balance | Balance | Balacne | Balance | Balance | Balance | Balance | Balance | Balance | Balance | Balance | Balance |
| Water | 10 | 10 | 10 | 10 | 10 | 10 | 10 | 10 | 10 | 10 | 10 | 10 |
| Detergency (%) | 86 | 68 | 83 | 68 | 84 | 68 | 84 | 68 | 84 | 68 | 84 | 69 |
| Difference in Detergency (%) | 18 | | 15 | | 16 | | 16 | | 16 | | 15 | |

| Run No. | 60A-a[8] | 60A-b | 60B-a[8] | 60B-b | 60C-a[8] | 60C-b | 60D-a[8] | 60D-b | 60E-a[8] | 60E-b | 60F-a[8] | 60F-b |
|---|---|---|---|---|---|---|---|---|---|---|---|---|
| Detergent Composition (%) | | | | | | | | | | | | |
| AOS[1] | 48.0 | 48.0 | 21.0 | 21.0 | 12.0 | 12.0 | 33.0 | 33.0 | 42.0 | 42.0 | 30.0 | 30.0 |
| LAS[2] | 0 | 0 | 24.0 | 24.0 | 24.0 | 24.0 | 0 | 0 | 0 | 0 | 12.0 | 12.0 |
| AS[3] | — | — | — | — | — | — | — | — | — | — | — | — |
| TSPP[4] | 12.0 | 12.0 | 15.0 | 15.0 | 24.0 | 24.0 | 27.0 | 27.0 | 18.0 | 18.0 | 18.0 | 18.0 |
| STP[5] | — | — | — | — | — | — | — | — | — | — | — | — |
| Enzyme[6] | 0.5 | 0 | 0.5 | 0 | 0.5 | 0 | 0.5 | 0 | 0.5 | 0 | 0.5 | 0 |
| Sodium Silicate[7] | 13 | 13 | 13 | 13 | 13 | 13 | 13 | 13 | 13 | 13 | 13 | 13 |
| Sodium Carbonate | 5 | 5 | 5 | 5 | 5 | 5 | 5 | 5 | 5 | 5 | 5 | 5 |
| CMC | 0.6 | 0.6 | 0.6 | 0.6 | 0.6 | 0.6 | 0.6 | 0.6 | 0.6 | 0.6 | 0.6 | 0.6 |
| Glauber's Salt | Balance | Balance | Balance | Balance | Balance | Balance | Balance | Balance | Balance | Balance | Balance | Balance |
| Water | 10 | 10 | 10 | 10 | 10 | 10 | 10 | 10 | 10 | 10 | 10 | 10 |
| Detergency (%) | 88 | 72 | 87 | 70 | 87 | 71 | 87 | 71 | 87 | 71 | 87 | 71 |
| Difference in Detergency (%) | 16 | | 17 | | 16 | | 16 | | 16 | | 16 | |

| Run No. | 60F'-a[8] | 60F'-b | 60F''-a | 60F''-b | 60G-a | 60G-b | 60H-a | 60H-b | 60I-a | 60I-b | 60J-a | 60J-b |
|---|---|---|---|---|---|---|---|---|---|---|---|---|
| Detergent Composition (%) | | | | | | | | | | | | |
| AOS[1] | 30.0 | 30.0 | 30.0 | 30.0 | 54.0 | 54.0 | 18.0 | 18.0 | 4.8 | 4.8 | 27.0 | 27.0 |
| LAS[2] | — | — | 12.0 | 12.0 | 0 | 0 | 30.0 | 30.0 | 24.0 | 24.0 | 0 | 0 |
| AS[3] | 12.0 | 12.0 | — | — | — | — | — | — | — | — | — | — |
| TSPP[4] | 18.0 | 18.0 | — | — | 6.0 | 6.0 | 12.0 | 12.0 | 31.2 | 31.2 | 33.0 | 33.0 |
| STP[5] | — | — | 18.0 | 18.0 | — | — | — | — | — | — | — | — |
| Enzyme[6] | 0.5 | 0 | 0.5 | 0 | 0.5 | 0 | 0.5 | 0 | 0.5 | 0 | 0.5 | 0 |
| Sodium Silicate[7] | 13 | 13 | 13 | 13 | 13 | 13 | 13 | 13 | 13 | 13 | 13 | 13 |
| Sodium Carbonate | 5 | 5 | 5 | 5 | 5 | 5 | 5 | 5 | 5 | 5 | 5 | 5 |
| CMC | 0.6 | 0.6 | 0.6 | 0.6 | 0.6 | 0.6 | 0.6 | 0.6 | 0.6 | 0.6 | 0.6 | 0.6 |

TABLE 2-continued

| | | | | | | | | | | | | |
|---|---|---|---|---|---|---|---|---|---|---|---|---|
| Glauber's Salt | Balance | Balance | Balance | Balance | Balance | Balance | Balance | Balance | Balance | Balance | Balance | Balance |
| Water | 10 | 10 | 10 | 10 | 10 | 10 | 10 | 10 | 10 | 10 | 10 | 10 |
| Detergency (%) | 87 | 70 | 84 | 70 | 85 | 70 | 85 | 70 | 85 | 70 | 85 | 71 |
| Difference in Detergency (%) | 17 | | 14 | | 15 | | 15 | | 15 | | 14 | |

(REMARKS)
[1]Sodium α-olefin sulfonates having 14 to 18 carbon atoms.
[2]Sodium linear alkylbenzine sulfonates having alkyl groups of 11 to 13 carbon atoms.
[3]Sodium alkyl sulfate having 12 to 14 carbon atoms.
[4]Tetrasodium pyrophosphate containing 1.5% of sodium orthophosphate and 1% of sodium tripolyphosphate.
[5]Sodium Tripolyphosphate.
[6]ALCALASE 1.5M (NOVO INDUSTRI A/S) (0.5% of Enzyme corresponds to 7.5 ANSON units per 1 kg of composition).
[7]JIS K 1408 #2 sodium silicate.
[8]Detergent compositions according to the present invention.

COMPARATIVE EXAMPLES 2 AND 3

The detergent compositions having the compositions listed in Table 3 below were prepared by using the AOS and enzyme used in Example 1. The detergent power of the compositions was evaluated in the same manner described in Example 1. The cationic agglomerate used in the Comparative Examples 2 and 3 contained 25.6% ditallow dimethyl ammonium chloride, 8.5% aminal fatty alcohol, 48.8% sodium montmorillonite clay, 2.6% disodium pyrophosphate and 14.5% water.

TABLE 3

| Comparative Example | 2 | 3 |
|---|---|---|
| AOS | 8.0 | 8.0 |
| Animal fatty Alcohol condensed with 11 mol of Ethylene Oxide | 0.5 | 0.5 |
| Sodium Orthophosphate | 10.0 | 10.0 |
| Sodium Pyrophosphate | 6.0 | 6.0 |
| Sodium Silicate (mol ratio = 2.0) | 10.0 | 10.0 |
| Glauber's Salt | 4.46 | 4.76 |
| CMC | 0.47 | 0.47 |
| EDTA 4Na | 0.21 | 0.21 |
| Brightener | 0.23 | 0.23 |
| Water | 7.0 | 7.0 |
| Sodium Perborate tetrahydrate | 32.0 | 32.0 |
| Enzyme | 0.3 | 0 |
| Cationic Agglomerate | 16.4 | 16.4 |
| Magnesium Sulfate | 4.0 | 4.0 |
| Polyethylene Glycol 400 | 0.25 | 0.25 |
| Perfume | 0.18 | 0.18 |

TABLE 3-continued

| Comparative Example | 2 | 3 |
|---|---|---|
| Detergent Power (%) | 67 | 55 |
| Difference in Detergent Power (%) | 12 | |

We claim:

1. An enzyme-containing detergent composition comprising (I) (a) at least one α-olefin sulfonate having 10 to 20 carbon atoms, (b) at least one anionic surface active agent having an $SO_3$ or $SO_4$ group other than said olefin sulfonate, and (c) at least one pyrophosphate selected from the group consisting of sodium pyrophosphate and potassium pyrophosphate and (II) at least one enzyme selected from the group consisting of proteases, amylases and lipases, wherein the total amount of said components (a), (b) and (c) is at least 25% by weight based on the total amount of the detergent composition and the weight ratio of (a): (b):(c) is within the area enclosed by the points A[(a):(b):(c)=80:0:20], B[(a):(b):(c)=35:40:25], C[(a):(b):(c)=20:40:40] and D[(a):(b):(c)=55:0:45], defined in the triangular diagram of the drawing.

2. The enzyme-containing detergent composition as claimed in claim 1, wherein said enzyme is at least one proteolytic enzyme derived from bacteria.

3. The enzyme-containing detergent composition as claimed in claim 2, wherein the detergent composition has an enzyme activity of 1 to 40 Anson units per 1 kg of the detergent composition.

* * * * *